US006206320B1

(12) United States Patent
Küsters et al.

(10) Patent No.: US 6,206,320 B1
(45) Date of Patent: Mar. 27, 2001

(54) METHOD FOR OPERATING A CHEESE-PRODUCING TEXTILE MACHINE

(75) Inventors: Gerard Küsters, Selfkant-Havert; Franz-Josef Flamm, Stolberg; Christian Sturm, Krefeld, all of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/347,239

(22) Filed: Jul. 2, 1999

(30) Foreign Application Priority Data

Jul. 2, 1998 (DE) ..... 198 29 597

(51) Int. Cl.[7] ..... B65H 54/38
(52) U.S. Cl. ..... 242/477.4; 242/477.8
(58) Field of Search ..... 242/477.4, 477.5, 242/477.7, 477.8

(56) References Cited

U.S. PATENT DOCUMENTS

| | | | | |
|---|---|---|---|---|
| 3,847,364 | * | 11/1974 | Rohner et al. | 242/18.1 |
| 4,135,673 | * | 1/1979 | Gallus et al. . | |
| 4,504,021 | * | 3/1985 | Schippers et al. | 242/18.1 |
| 4,504,024 | * | 3/1985 | Gerhartz | 242/18.1 |
| 4,770,961 | * | 9/1988 | Tanaka et al. | 430/14 |
| 5,035,370 | * | 7/1991 | Hermanns | 242/18.1 |
| 5,056,724 | * | 10/1991 | Prodi et al. | 242/18.1 |
| 5,112,000 | * | 5/1992 | Derichs et al. | 242/18 DD |
| 5,639,037 | * | 6/1997 | Marangone et al. | 242/18.1 |
| 5,735,473 | * | 4/1998 | Hermanns et al. . | |
| 5,826,815 | * | 10/1998 | Hermanns et al. | 242/477.8 |
| 5,857,638 | * | 1/1999 | Hermanns et al. | 242/477.6 |

FOREIGN PATENT DOCUMENTS

| | | |
|---|---|---|
| 29 14 924 A1 | 10/1980 | (DE) . |
| 32 10 244 A1 | 9/1983 | (DE) . |
| 21 29 318 C2 | 12/1983 | (DE) . |
| 32 19 880 A1 | 2/1984 | (DE) . |
| 33 24 889 A1 | 1/1985 | (DE) . |
| 39 27 142 A1 | 2/1991 | (DE) . |
| 42 39 579 A1 | 5/1994 | (DE) . |
| 295 20 857 U1 | 5/1996 | (DE) . |
| 0 399 243 B1 | 11/1994 | (EP) . |
| 3-264472 | 11/1991 | (JP) . |
| 4-345473 | 1/1992 | (JP) . |

* cited by examiner

*Primary Examiner*—Donald P. Walsh
*Assistant Examiner*—Collin A. Webb
(74) *Attorney, Agent, or Firm*—Kennedy Covington Lobdell & Hickman, LLP

(57) ABSTRACT

A method for operating a cheese-producing textile machine which produces cheeses of the "random winding" type, wherein the contact pressure of the cheese on the yarn guiding cylinder is reduced and the cheese is simultaneously charged with a braking torque for preventing pattern windings. The angular velocity w of the cheese (4) is continuously determined and processed in a control device (18) such that, when or shortly prior to reaching a so-called pattern winding zone (BWZ), the angular velocity $w_1$ determined by the diameter $d_1$ of the cheese (4) is reduced by means of the definite adjustment of the contact pressure with which the cheese (4) rests on the yarn guiding cylinder (3), to an angular velocity $w_2$ which lies below the angular velocity $w_k$ of a cheese of the critical diameter $d_k$, driven without slippage, which causes pattern winding.

12 Claims, 3 Drawing Sheets

METHOD FOR OPERATING A CHEESE-PRODUCING TEXTILE MACHINE

FIELD OF THE INVENTION

The present invention relates to a method for operating a cheese-producing textile machine which produces cheeses of the "random winding" type, wherein the contact pressure of the cheese on the yarn guiding cylinder is reduced and the cheese is simultaneously applied a braking torque for preventing pattern windings.

BACKGROUND OF THE INVENTION

When winding cheeses, a distinction is basically made between two types of windings: a. precision winding, and b. random winding. With precision winding, there is a constant relationship between the number of bobbin revolutions and the speed of the yarn cross winding during the entire bobbin travel, so that the winding ratio remains the same during the entire winding process. However, the yarn crossing angle decreases with increasing bobbin diameter. No pattern zones occur with a "precision winding" type of cheese winding operation. The bobbin has a high winding density and has satisfactory unwinding properties, because of which high draw-off speeds can be achieved. But the solidity of the yarn body is limited because of the constantly decreasing yarn crossing angle with the increase of the bobbin diameter. Moreover, the decreasing yarn crossing angle causes an increase of the winding density toward the edges, which can result in an uneven penetration of dyeing liquor in a dye process.

With random winding there is a fixed relationship between the velocity of the peripheral or circumferential surface of the bobbin and the speed of yarn cross winding. The yarn crossing angle is kept constant by this relationship, while the winding ratio, i.e. the number of bobbin turns per double lift, becomes smaller with increasing diameter. The advantages of random winding lie in that it is possible to create relatively solid yarn bodies with "random winding", which have a very even density.

However, it is disadvantageous that the decrease of the winding ratio is hyperbolic and that in certain ranges of the winding ratio wherein, for example, the winding ratio has a whole-number value, so-called patterns or reflex patterns are created. In these so-called pattern winding zones, the yarns of several successive winding layers lie on top of or very closely next to each other. The patterns result in the cheese being denser in these areas, so that, for example, uneven coloring can result during dyeing. There is the additional danger that the yarn areas which are placed on top of, or closely next to each other, laterally slide on top of each other and in the process become jammed, which has very disadvantageous results for the unwinding properties of a cheese.

Therefore numerous devices and methods have been developed in the past, which are intended to prevent the creation of the above mentioned pattern winding zones. For example, a pattern disruption method for preventing pattern windings is known from European Patent Document EP 0 399 243 B1 wherein, starting from a basic number of revolutions, a friction roller in the form a grooved roller is braked and then accelerated again in short intervals by means of the drive motor such that slippage occurs during acceleration as well as during braking.

A pattern disruption method is also known from German Patent Publication DE 42 39 579 A1, wherein the number of revolutions of a yarn guiding cylinder and the number of revolutions of a cheese are detected, and the measured results are evaluated in a computer in such a way that it can be determined at what time during the winding process a winding ratio range, which causes the generation of patterns, is passed. In this so-called pattern winding zone the cheese is braked by the bobbin brake in relation to the yarn guiding cylinder such that slippage is generated between them. Following passage through the pattern winding zone, the bobbin brake is released again, so that the cheese is once again driven without slippage. No defined reduction of the number of revolutions of the cheese is provided in the pattern winding zone with this method and is also not possible with the known device.

Moreover, pattern disruption methods have also been proposed in which the contact pressure of the cheese on the yarn guiding cylinder is varied. For example, a pattern disruption method is known from German Patent Publication DE 33 24 889 A1, wherein the cheese held in the creel is continuously lifted to different heights in such a way that the contact between the cheese and the yarn guiding cylinder continuously changes in respect to the length of time and the contact pressure. In addition, the drive of the yarn guiding cylinder is turned on and off in a constantly changing manner.

A winding device is known from German Patent Publication DE 39 27 142 A1, in which the contact pressure of the cheese on the yarn guiding cylinder can be reduced in a pattern winding zone. With this known winding device the creel is connected with an electro-mechanical torque actuator, preferably a d.c. motor which operates from a standing start, and which in turn is connected to a control device. The bobbin brake can furthermore be actuated via the control device. When a pattern winding zone is encountered, the creel is acted upon by the torque actuator in a "relief" direction, while the cheese held in the creel is simultaneously braked.

The pattern disruption methods of the prior art have so far not been satisfactory in actual use, since no exact regulation of the angular velocity of the cheese in the pattern winding zone had been provided by these methods. By means of the known devices it has been impossible to maintain a preset angular velocity with sufficient accuracy, either by regulating the contact pressure, with which the cheese rests on the yarn guiding cylinder, or via the bobbin brake.

Continuous problems have arisen with the known pattern disruption method because of the appearance of so-called remaining patterns, in particularly in the end phases of the cheeses in which few slippages occur.

OBJECT AND SUMMARY OF THE INVENTION

Based on the above mentioned prior art, it is an object of the present invention to improve the known pattern disruption methods.

In accordance with the present invention, this object is attained by providing a method of operating a cheese-producing textile machine for producing cheeses of the random winding type by the basic steps of reducing the contact pressure of the cheese on a yarn guiding cylinder and simultaneously applying a braking torque to the cheese for preventing pattern windings. More specifically, the present invention contemplates the steps of continuously determining a prevailing angular velocity of the cheese, processing the prevailing angular velocity in a control device, and when or shortly prior to reaching a pattern winding zone, adjusting the contact pressure with which the cheese rests on the yarn guiding cylinder for reducing the prevailing angular velocity determined by the then-prevailing diameter of the cheese to an altered angular velocity below a critical angular velocity which a cheese of a diameter driven without slippage would have.

The method in accordance with the invention has the advantage that it makes it possible to dependably bypass pattern winding ranges by means of a relatively small technical outlay and therefore cost-effectively. Thus, when it is determined by means of the control device that the cheese has reached a defined diameter, and therefore a pattern winding zone, the angular velocity of the cheese is reduced by the defined control of the contact pressure with which the cheese rests on the yarn guiding cylinder to an angular velocity which lies below the critical angular velocity of the cheese, and the pattern winding zone is simply bypassed in this way. These critical angular velocities at which pattern winding appears occur at defined known cheese diameters if a cheese is driven without slippage.

Preferably, the adjustment of the contact pressure with which the cheese rests on the yarn guiding cylinder at or shortly prior to reaching a pattern winding zone may be achieved by reducing the prevailing angular velocity determined by the then-prevailing diameter of the cheese to achieve the altered angular velocity which a cheese of a diameter driven without slippage would have when leaving the pattern winding zone and maintaining the altered angular velocity of the cheese until the pattern winding zone has been passed. The altered angular velocity is exactly maintained here by an appropriate regulation of the contact pressure until the pattern winding zone is left. It is also possible in this way to prevent the remaining patterns, which up to now interfered, in a dependable manner.

The relatively small technical outlay with this invention is a result, among other things, of the fact that the cheese can be acted upon with a constant, or almost constant, and comparatively weak braking torque in the area of the pattern winding zone, because the regulation of the number of revolutions of the cheese takes place only via the contact pressure of the cheese on the yarn guiding cylinder. Such a constant braking torque, which as a rule is not very great, can be achieved without problems by means of the existing bobbin brakes.

In an advantageous embodiment of the invention it is possible to even completely do without the introduction of a brake torque via the bobbin brake. Instead, it is possible to obtain the braking torque from the air friction of the cheese, and/or the bearing friction of the bobbin holder and/or the friction of the yarn to be rewound.

It is also contemplated that the defined regulation of the contact pressure, and therefore the exact setting of the number of revolutions of the cheese, may be accomplished via a torque transmitter embodied as a stepper motor. Here, the stepper motor may be a component of a creel adjustment installation, such as extensively described in the post-published German Patent Publication DE 198 17 363.3.

Further features, details and advantages of the invention will be described and understood from an exemplary embodiment, which will be explained below with reference to the accompanying drawings.

DETAILED DESCRIPTION OF THE PREFERRED EMBODIMENT

Figure 1:
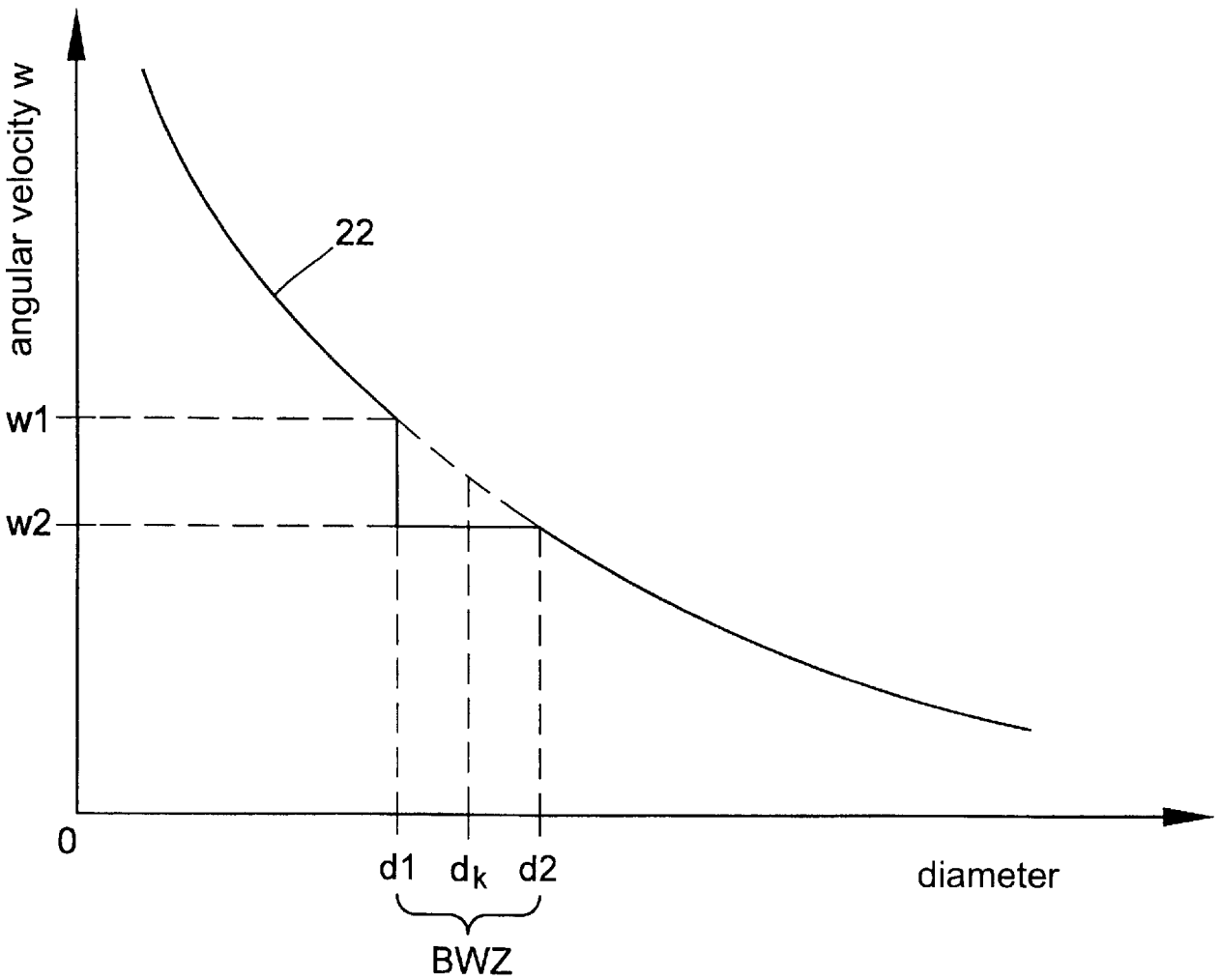
FIG. 1 schematically represents the progressing number of revolutions of a cheese in the course of its winding when employing a first embodiment of the method in accordance with the present invention, in particular in the range of a pattern winding zone, FIG. 2 schematically represents the progressing number of revolutions of a cheese in the course of its winding when employing a second embodiment of the method in accordance with the invention.
Figure 2:
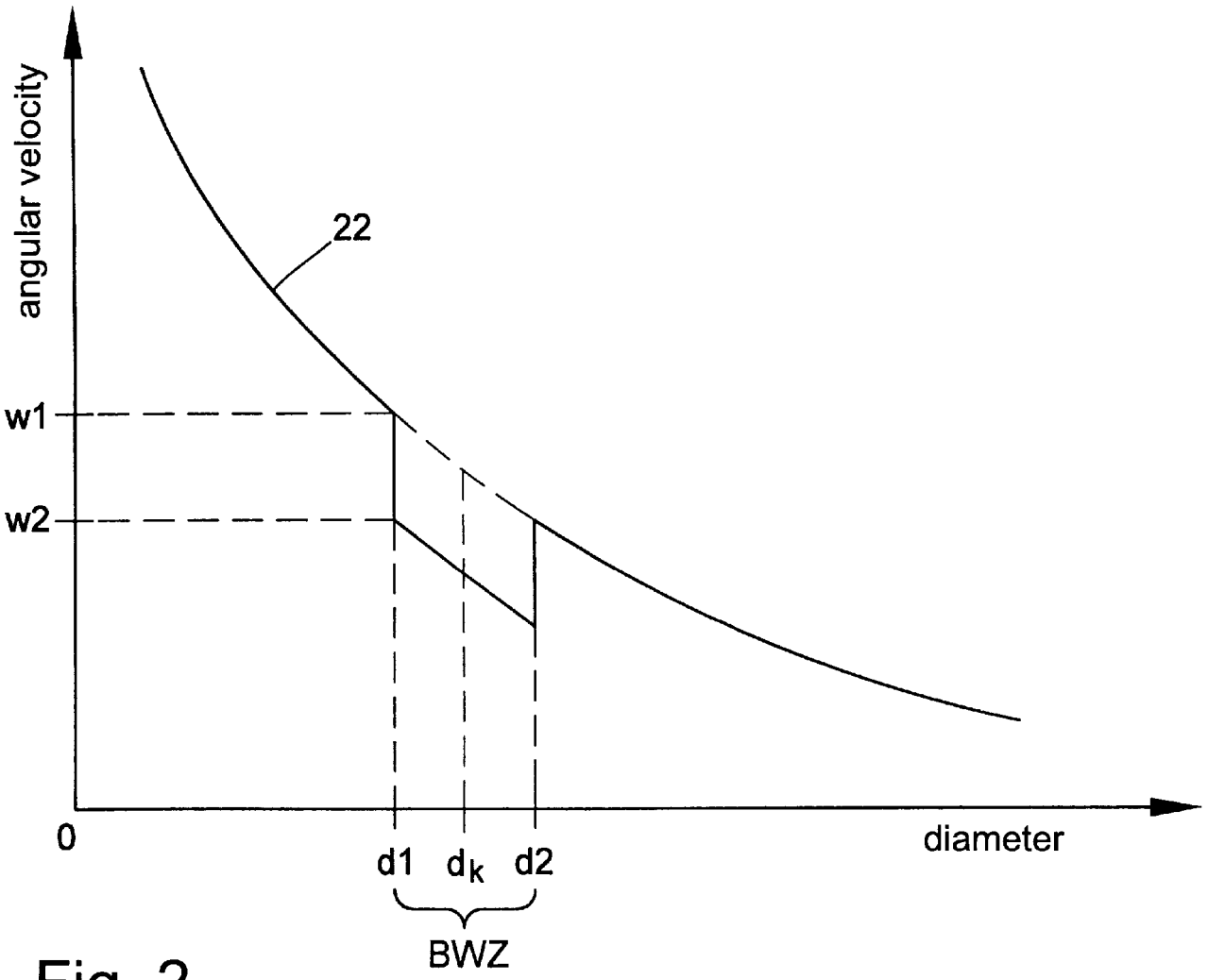

The diagrams represented in FIGS. 1 and 2 respectively show by means of a curve 22 the progress of the number of revolutions of a cheese in the course of winding thereof when employing the pattern disruption method in accordance with the present invention. The progression of the number of revolutions, or respectively the angular velocity of a cheese, in the range of a pattern winding zone BWZ is represented in particular. Here, the angular velocity w of the cheese is represented on the ordinate and the diameter d of the cheese is represented on the abscissa. In this case FIG. 1 shows a first embodiment and FIG. 2 an alternative embodiment variation.

As can be seen from the curve 22 in FIGS. 1 and 2, the angular velocity w of the cheese 4 continuously decreases with the increasing bobbin diameter d. A critical range, a so-called pattern winding zone BWZ, is reached at a bobbin diameter $d_1$. The pattern winding zone BWZ extends on both sides of a critical cheese diameter $d_k$, in which, as already explained in the introduction to the specification, a winding ratio between the yarn guiding cylinder and the cheese occurs which leads to the development of so-called pattern windings. The exact propagation of the critical pattern winding zone BZW here is a function of various factors, for example the yarn count, the yarn material, the winding density, etc.

In accordance with the pattern disruption method indicated in FIG. 1, the angular velocity $w_1$, which the cheese 4 has because of its diameter when reaching the pattern winding zone, is initially reduced by means of the defined control of the creel to an angular velocity $w_2$, and this angular velocity $w_2$ is constantly maintained while passing through the pattern winding zone BWZ. Here, the angular velocity $w_2$ corresponds to an angular velocity at which a cheese of a diameter $d_2$, when driven at a constant speed and without slippage by the yarn guiding cylinder, would rotate. In this case the angular velocity $w_2$ clearly lies below the angular velocity which a cheese with the critical diameter $d_k$, when driven without slippage, would have.

At the end of the pattern winding zone BWZ, i.e. when the cheese has reached the diameter $d_2$, the angular velocity $w_2$ then again corresponds to the progress of the number of revolutions of an almost slippage-free driven cheese, represented by means of the curve 22. The above described method is repeated as soon as the cheese reaches the next pattern winding zone BWZ in its bobbin travel.

In the exemplary embodiment in accordance with FIG. 2, initially the angular velocity $w_1$ of the cheese is also reduced to an angular velocity $w_2$ when a cheese diameter $d_1$ has been reached, i.e. at the start of the pattern winding zone BWZ. In this case the angular velocity $w_2$ lies below the angular velocity which is determined by the critical cheese diameter $d_k$.

As indicated in FIG. 2, the angular velocity $w_2$ is further reduced during the passage through the pattern winding zone BWZ and, by an appropriate load on the creel, is again increased at the end of the pattern winding zone to an angular velocity which corresponds to the angular velocity of a cheese with the diameter $d_2$ when driven without slippage.

In this case, it is possible to employ the above described pattern disruption method in place of a known pattern disruption method mentioned in the Background section above or in addition to such a pattern disruption method.

Figure 3:
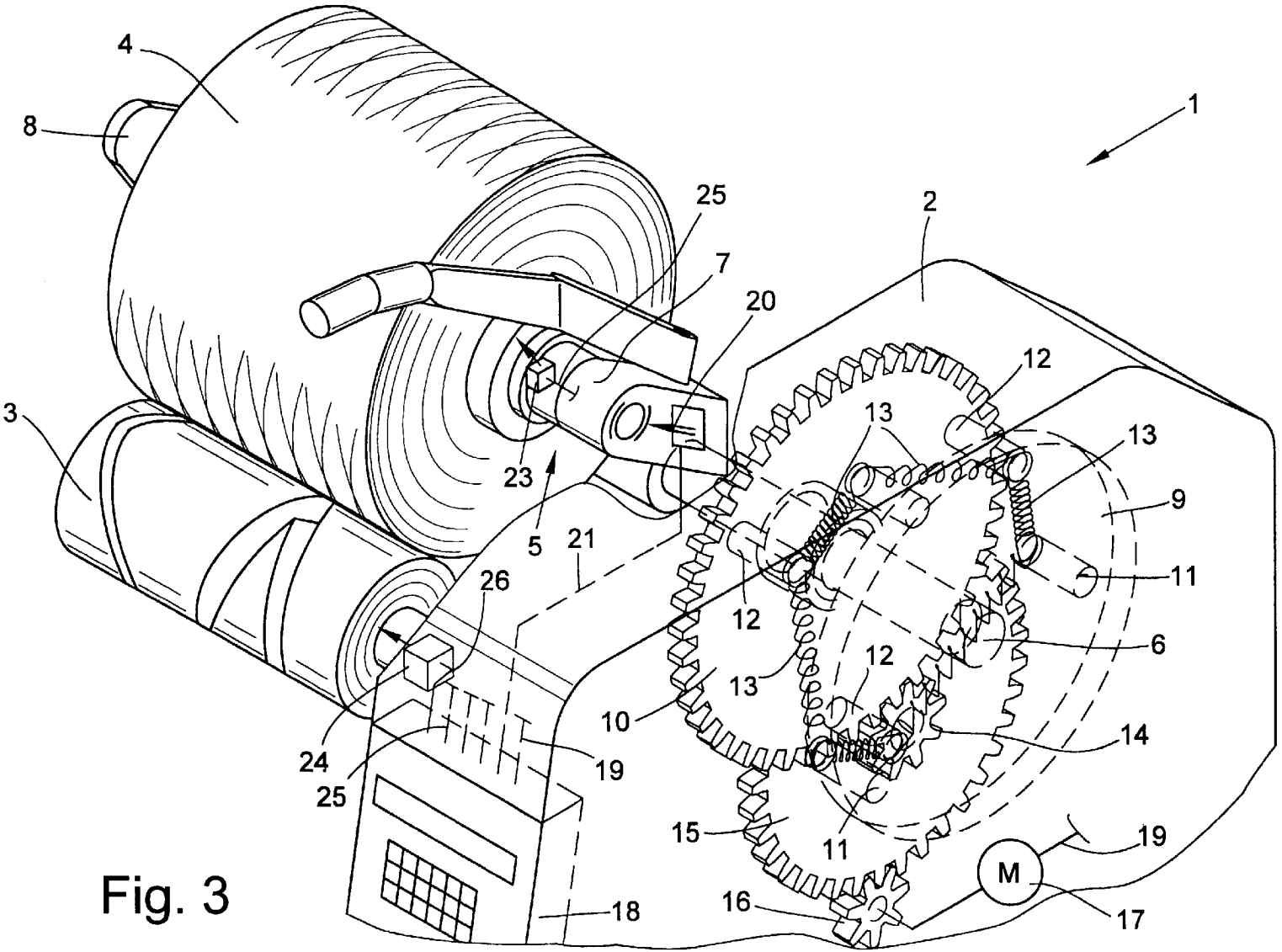
FIG. 3 is a perspective of a cheese winding device which permits the execution of the method in accordance with the invention.

FIG. 3 represents a device which permits the execution of the pattern disruption method in accordance with the invention. A yarn guiding cylinder 3, which is driven by an electric motor, not represented, is seated in the winding head housing 2 of a work station, indicated overall at 1, of a cheese-producing textile machine. In turn, the yarn guiding cylinder 3 drives a cheese 4 by means of friction.

In this case, the cheese 4 is held in a creel 5, which is connected, fixed against relative rotation, with a pivot shaft 6. The pivot shaft 6 is arranged parallel with the axis of the yarn guiding cylinder 3 and is seated for limited pivotability on the winding head housing 2. As is customary, the creel 5 has two bobbin arms 7 and 8, which are provided with rotatably seated bobbin plates. A tube is held between the bobbin plates, on which a yarn is wound for forming the cheese 4. In a manner not shown, at least one of the bobbin arms 7, 8 can be laterally pivoted away, together with the associated bobbin plate, from the cheese, so that a finished cheese can be removed from the creel 5 and an empty tube inserted.

A torque transmitter acts on the pivot shaft 6 of the creel 5. Among other things, this torque transmitter has a connecting plate 9, which is connected, fixedly against relative rotation, with the pivot shaft 6, and a gear wheel 10, which is rotatably seated coaxially with the pivot shaft 6. The connecting plate 9 is provided with connecting bolts 11, which are oriented toward the gear wheel 10. Corresponding connecting bolts 12 are provided on the gear wheel 10. Identical spring elements 13 in the form of helical springs have been inserted as transfer elements between the connecting bolts 11 of the connecting plate 9 and the connecting bolts 12 of the gear wheel 10, which spring elements are deformed in the opposite direction when the gear wheel 10 and the connecting plate 9 are relatively rotated.

The rotatably seated gear wheel 10 meshes with a pinion 14 of a reduction gear, whose outer ring 15 is connected to a stepper motor 15 via a drive pinion 16. Because the drive pinion 16, the outer ring 15 and the pinion 14 are rotatably seated on the winding head housing 2, each rotary movement of the stepper motor 17 fixed on the winding head housing 2 can be transmitted via the reduction gear, for example at a ratio of 1:25. The stepper motor 17 which, for example, is designed for individual steps of approximately 1.8, is controlled by means of a winding head computer and in this way can perform a preselected number of revolutions or a preselected number of individual steps, which result in a torque on the creel 5, by means of which the contact pressure of the cheese 4 on the yarn guiding cylinder 3 can be adjusted.

The operation of the device and the progression of the method in accordance with the present invention is as follows. The number of revolutions of the cheese 4, as well as the number of revolutions of the yarn guiding cylinder 3, are continuously determined by means of sensors 23 and 24, which are connected with the winding head computer 18 by means of appropriate signal lines 25, 26. The actual winding ratio of the cheese 4 is constantly calculated in the winding head computer 18 from these data, as well as from the known structural data of the machine.

When the diameter d of the cheese 4 approaches a pattern winding zone BWZ, i.e. a range in which, for example, during slippage-free operation the number of revolutions of the yarn guiding cylinder is a whole number multiple of the number of revolutions of the cheese, the number of revolutions of the cheese is reduced from an instantaneous number of revolutions $n_1$ based on the cheese diameter, to an adjustable number of revolutions $n_2$.

In this case the reduction of the number of revolutions $n_1$ of the cheese 4 to a number of revolutions $n_2$, as well as the exact maintenance of this number of revolutions takes place in that, on the one hand, the cheese 4 is acted upon with a constant braking torque, for example by means of the bobbin brake 20 which is connected via a signal line 21 with the winding head computer 18, and on the other hand the contact pressure, with which the cheese 4 rests on the yarn guiding cylinder 3, is reduced by a defined lifting of the creel 5. By means of a corresponding increase or decrease of this contact pressure it is possible to exactly adjust the desired number of revolutions $n_2$ of the cheese 4.

Thus, pattern windings can be prevented in that, by means of the stepper motor 17, the gear wheel 10 is rotated into a position which corresponds to a calculated contact pressure of the cheese 4 on the yarn guiding cylinder 3. In this case, the control of the contact pressure as a function of the winding progression of the cheese, or respectively of the cheese diameter, by adjusting the stepper motor 17 takes place in the winding head computer 18 by using a control program. Such a control program calculates the required position of the stepper motor, expressed in positive or negative steps, for example on the basis of the above described sensor data which are provided to the winding head computer during the entire bobbin travel.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for preventing pattern windings in a random wound cheese produced on a textile machine comprising the steps of:

(a) randomly winding a cheese on the textile machine, the cheese contacting and being driven by a yarn guiding cylinder;

(b) continuously determining a prevailing angular velocity of the cheese being wound, (c) processing the prevailing angular velocity in a control device, and (d) throughout a pattern winding zone defined about a critical angular velocity, i applying braking torque to the cheese being wound, and ii adjusting a pressure with which the cheese contacts the yarn guiding cylinder such that slippage between the cheese and the yarn guiding cylinder occurs and the angular velocity is maintained below the critical angular velocity.

2. The method in accordance with claim 1, wherein the angular velocity is maintained during the pattern winding zone at a constant angular velocity corresponding to an angular velocity of a cheese wound substantially without slippage when exiting the pattern winding zone.

3. The method in accordance with claim 2, wherein said step of applying braking torque to the cheese being wound during the pattern winding zone comprises applying a substantially constant braking torque to the cheese.

4. The method in accordance with claim 3, wherein said step of applying a substantially constant braking torque to the cheese is provided by air friction of the rotating cheese.

5. The method in accordance with claim 3, wherein said step of applying a substantially constant braking torque to the cheese is provided by bearing friction of a bobbin holder of a creel holding the cheese.

6. The method in accordance with claim 3, wherein said step of applying a substantially constant braking torque to the cheese is provided by yarn torque caused by friction during the winding process.

7. The method in accordance with claim 3, wherein said step of adjusting the pressure with which the cheese contacts the yarn guiding cylinder comprises pivoting a creel with a stepper motor.

8. The method in accordance with claim 3, wherein said step of applying a substantially constant braking torque to the cheese is provided by a bobbin brake.

9. The method in accordance with claim 1, further comprising winding the cheese without substantial slippage between the cheese and yarn guiding cylinder outside of pattern winding zones.

10. The method in accordance with claim 1, wherein the angular velocity of the cheese is immediately reduced to an angular velocity less than that of the critical angular velocity when a pattern winding zone is reached, and then is continually reduced until the pattern winding zone is passed.

11. The method in accordance with claim 10, wherein the angular velocity of the cheese is reduced below an angular velocity of a cheese wound substantially without slippage when exiting the pattern winding zone.

12. The method of claim 11, further comprising increasing the angular velocity of the cheese upon exiting the pattern winding zone to the angular velocity of a cheese wound substantially without slippage when exiting the pattern winding zone.

* * * * *